US007880713B2

(12) United States Patent
Lee

(10) Patent No.: US 7,880,713 B2
(45) Date of Patent: Feb. 1, 2011

(54) METHOD OF INCREASING EFFICIENCY OF VIDEO DISPLAY AND RELATED APPARATUS

(75) Inventor: Pei-Chang Lee, Taoyuan County (TW)

(73) Assignee: Qiada Corporation, Taoyuan County (TW)

( * ) Notice: Subject to any disclaimer, the term of this patent is extended or adjusted under 35 U.S.C. 154(b) by 764 days.

(21) Appl. No.: 11/872,044

(22) Filed: Oct. 15, 2007

(65) Prior Publication Data

US 2008/0180432 A1 Jul. 31, 2008

(30) Foreign Application Priority Data

Jan. 29, 2007 (TW) ..... 9610323 A

(51) Int. Cl.
*G09G 3/36* (2006.01)

(52) U.S. Cl. ..... 345/99; 345/94

(58) Field of Classification Search ..... 345/214, 345/690, 87, 94, 95, 99
See application file for complete search history.

(56) References Cited

U.S. PATENT DOCUMENTS 5,130,810 A * 7/1992 Ryan ..... 386/9
5,206,726 A * 4/1993 Okuda ..... 348/497
6,501,451 B1 12/2002 Sakashita
6,664,977 B1 * 12/2003 Masumoto ..... 345/698
6,724,358 B2 4/2004 Ban
6,903,716 B2 6/2005 Kawabe
7,259,799 B2 * 8/2007 Kuhn et al. ..... 348/684

* cited by examiner

*Primary Examiner*—Ricardo L Osorio

(57) ABSTRACT

A method of increasing efficiency of video display includes receiving a first frame signal, where the first frame signal includes a first blank signal and a first image data, where the first blank signal includes a first sync signal, a first front-porch signal and a first back-porch signal. The method also includes separating the first blank signal and the first image data, performing image processing for the first image data for generating a second image data, and adding a second blank signal to the second image data for generating a second frame signal, where the second blank signal includes a second sync signal, a second front-porch signal and a second back-porch signal.

10 Claims, 7 Drawing Sheets

METHOD OF INCREASING EFFICIENCY OF VIDEO DISPLAY AND RELATED APPARATUS

BACKGROUND OF THE INVENTION

1. Field of the Invention

The present invention relates to a method of enhancing image display efficiency and a related apparatus, and more particularly to a method of enhancing image display efficiency and a related apparatus, using blank reducing.

2. Description of the Prior Art

According to vision persistence of human eyes' nature, an image-displaying manner for a cathode ray tube (CRT) display is developed to emit an electron beam scanning on the screen line-by-line rapidly to represent natural colors in electrical waveforms. An electron gun of the CRT emits the electron beam from one side of a horizontal line to the other side, and then moves to scan the next horizontal line from the same start side. The electron gun needs a positioning time to move and locate the start point of the next horizontal line and meanwhile no electron beam is emitted. Moreover, the CRT demands a signal to inform the electron gun to start to scan at certain time. According to a video timing specification provided for the CRT, a defined frame signal includes a horizontal component and a vertical component. The horizontal component includes image data with respect to each horizontal line and blank signals, each arranged between image data and image data. Each blank signal includes a front porch signal, a horizontal synchronization signal (Hsync) and a back porch signal. The front and back porch signals carry no information in order to provide the positioning time for the electron gun to move and locate the next horizontal line. The Hsync signal is utilized to inform the electron gun the time to start to scan. After a whole frame is scanned line by line, the electron tube moves back to the left-top corner of the screen and restarts a new frame scanning. As a result, the vertical component also provides a vertical front porch signal, a vertical synchronization signal (Vsync) and a vertical back porch signal and the functions thereof are the same as the corresponding signals of the horizontal component. A detailed specification is referred to Generalized Timing Formula (GTF) provided by the Video Electronics Standards Association (VESA).

With evolution of imaging technologies, LCDs have gradually replaced CRTS. A driving circuit of the LCD is used for driving the liquid crystals of the panel and includes gate drivers and source drivers. The gate drivers transmit scan signals to the scan lines (horizontal lines) so as to turn corresponding pixels on or off. The source drivers transmit image data signals to data lines so as to drive the liquid crystals. For a LCD, there are various functions available, such as resolution setting, display size change (ex. 4:3 or 16:9), and frame rate adjustment. Those functions involve image processes and timing technology. As a LCD of the prior art builds those functions, the performance may be restricted under the transmission bandwidth and buffer size. Take a LCD following the GTF for example. An internal buffer first duplicates the horizontal component of the frame signal. The original frame signal and its duplicated signal are performed required image processes and then displayed in a shorter period to increase the frame rate. However, as the frame rate is adjusted to a very high rate, the duplication for the frame signal may occupy large memory since the horizontal blank signals of the frame signal are duplicated with the image data. Therefore, large-space buffers are required for the LCD of the prior art to realize those functions.

Assume that a LCD of the prior art follows the VESA timing specification, and adopts a transmission interface with low voltage differential signaling (LVDS) technology having a maximum bandwidth of 85-90 MHz. The LCD displays video with a 1280×1024 resolution and a 60 Hz frame rate. In light of the VESA timing specification, horizontal and vertical pixels for each frame are 1688 and 1066 pixels, respectively. Normally the horizontal pixel number is 1.3 times the horizontal resolution while the vertical pixel number is 1.05 times the vertical resolution. The data rate can be calculated by the following formula:

Data Rate=the horizontal pixel number×the vertical pixel number×the frame rate÷the channel number of the LVDS $$=1688\times1066\times60\div2$$

$$=53.98\text{ MHz}$$

The calculation result shows that the data rate with respect to the 60 Hz frame rate is smaller than the maximum bandwidth. As the frame rate is adjusted to be 100 Hz, the data rate becomes 89.97 MHz, achieving the maximum bandwidth limit. As the frame rate is adjusted to be 120 Hz, the data rate is calculated as 107.96 MHz, exceeding the maximum bandwidth limit. The LVDS transmission interface cannot afford such high data rate. That is, the LCD is incapable of displaying video with a 120 Hz frame rate. The LCD eliminates the moving and positioning issues of the electron gun, but instead has to deal with switching delay and data transmission delay. The LCD requires much shorter preparation time than the CRT, and therefore the blank signal of the timing specification appears redundantly long when applied to the LCD, especially for the front and back porch signals. Therefore, as the LCD of the prior art adopts the traditional timing specification, various functions could be limited in their expansibility and flexibility.

Therefore, there is a high cost involved for the LCD of the prior art to go in quest of high bandwidth transmission interface and large-space buffer to achieve the functions in a wide practical range, such as frame rates available from 60 Hz to 120 Hz. The related LCD performance is restricted.

SUMMARY OF THE INVENTION

It is therefore a primary object of the present invention to provide a method of enhancing image display efficiency and related apparatus, using blank reducing.

The present invention discloses a method of enhancing image display efficiency. The method includes the following steps. A first frame signal is received and includes a first blank signal and first image data, where the first blank signal includes a first synchronization signal, a first front porch signal and a first back porch signal. The first blank signal and the first image data are separated. The first image data is processed to generate second image data. A second blank signal is combined with the second image data to generate a second frame signal, where the second blank signal includes a second synchronization signal, a second front porch signal and a second back porch signal.

The present invention further discloses a device for enhancing image display efficiency. The device includes a signal receiving unit, a signal separating unit, a image processing unit and a blank-signal processing unit. The signal receiving unit is used for receiving a first frame signal including a first blank signal and first image data, where the first blank signal includes a first synchronization signal, a first front porch signal and a first back porch signal. The signal separating unit is used for separating the first blank signal and the first image data. The image processing unit is used for processing the first image data to generate second image data. The blank-signal processing unit is used for combining a second blank signal with the second image data to generate a second frame signal, where the second blank signal includes a second synchronization signal, a second front porch signal and a second back porch signal.

These and other objectives of the present invention will no doubt become obvious to those of ordinary skill in the art after reading the following detailed description of the preferred embodiment that is illustrated in the various figures and drawings.

DETAILED DESCRIPTION

The present invention utilizes frame signal separating and blank signal reducing to economize the use of system resources, thereby enhancing related display functions.

Figure 1:
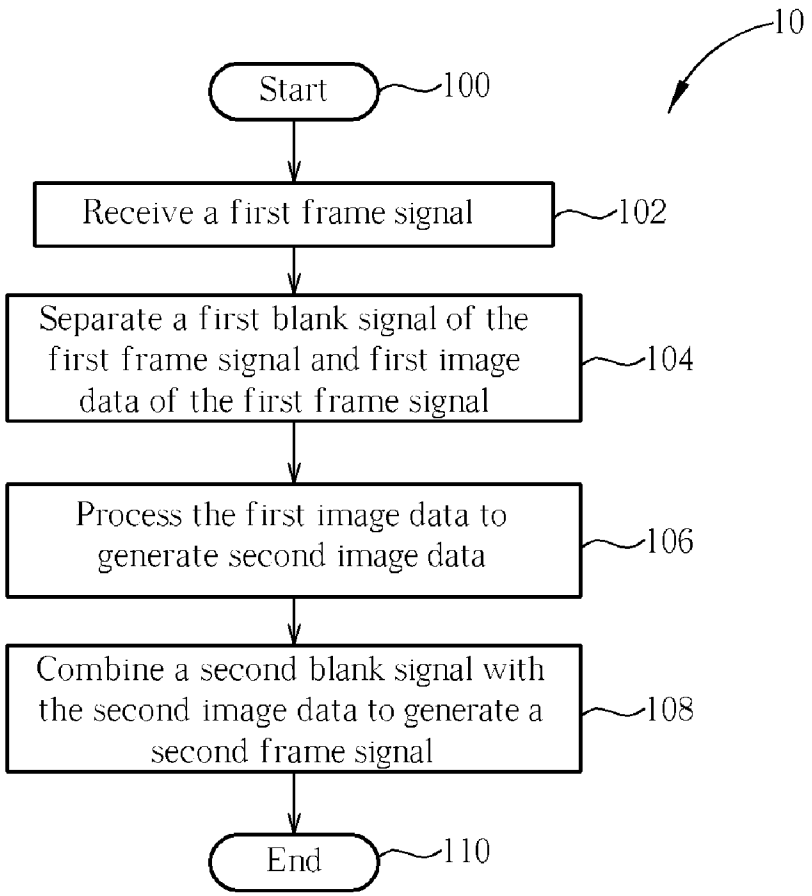
FIG. 1 is a schematic diagram of a process according to the present invention.

Please refer to FIG. 1, which is a schematic diagram of a process 10 according to the present invention. The process 10 includes the following steps:

Step 100: Start.

Step 102: Receive a first frame signal.

Step 104: Separate a first blank signal of the first frame signal and first image data of the first frame signal.

Step 106: Process the first image data to generate second image data.

Step 108: Combine a second blank signal with the second image data to generate a second frame signal.

Step 110: End.

According to the process 10, after a frame signal is received, image data is captured from the frame signal and is performed with predetermined image processes. The image-processed image data is then combined with a length-reduced blank signal to generate a new frame signal. In Step 102, the first frame signal includes the first blank signal and the first image data. The first blank signal includes a first synchronization signal (sync), a first front porch signal and a first back porch signal. The first front and back porch signals generally carry no useful information. The first frame signal is a digital signal and conforms to a traditional video timing specification, such as generalized timing formula (GTF) provided by the Video Electronics Standards Association (VESA). The first image data may appear as a different format based on the transmitting terminal, and could be a red, green, blue (RGB) signals or video component signals. In addition, the first synchronization signal, the first front signal and the first back porch signal are casually arranged ahead or behind the first image signal as long as the first synchronization signal is not coupled to the first image signal. In Step 106, the first image data could be overdriven first to generate a buffering image data, and the buffering image data is adjusted in the frame rate so as to generate the second image data. Overdrive is a LCD technology and can increase twist speed of the liquid crystals, thereby shortening reaction time of image display. Overdrive is well known for those skilled in the art, and the detailed operation is omitted. In Step 106, overdrive and frame rate adjustment are exchangeable in performing order. In Step 108, the second blank signal has similar signal arrangement to the first blank signal, and includes a second synchronization signal, a second front porch signal and a second back porch signal. The difference between the second and first front/back porch signals is that the lengths of the second front/back porch signals are shorter than the lengths of the first front/back porch signals. In the prior art, since no signal separation is performed on the first frame signal before image processes, the first blank signal takes part in the image processes with the first image data, resulting in extra use of system resources and memory space for blank signals in the prior art. In addition, the first front and back porch signals, conforming to the foregoing timing specification, carry useless information. Thus, performing the image processes on the first front and back porch signals is insignificant and results in system resource and memory wastes. In the prior art, the lengths of the first and back porch signals are determined for the requirement of the traditional timing specification. The lengths are so long that the first and back porch signals occupy the transmission bandwidth of the transmission interface. Therefore, the present invention shortens the lengths of the first blank signal to resolve the problems.

Figure 2:
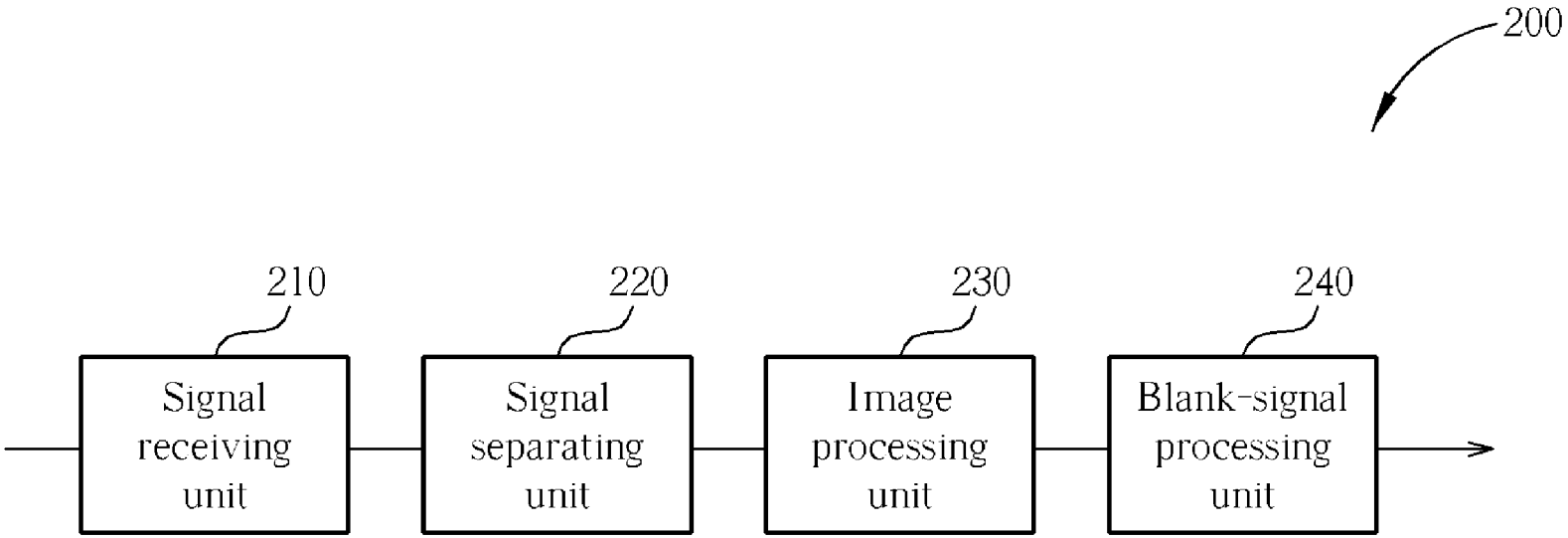
FIG. 2 is a schematic diagram of a device according to the present invention.

Please refer to FIG. 2, which is a schematic diagram of a device 200 according to the present invention. The device 200 is utilized to realize the process 10 and includes a signal receiving unit 210, a signal separating unit 220, a image processing unit 230 and a blank-signal processing unit 240. The signal receiving unit 210 receives the first frame signal and output the first frame signal to the signal separating unit 220. The signal separating unit 220 separates the first blank signal and the first image data, and outputs the first image data to the image processing unit 230. The image processing unit 230 processes the first image data with various image processes, such as overdrive and frame-rate adjustment, and outputs the processed second image data to the blank-signal processing unit 240. The blank-signal processing unit 240 combines the second blank signal with the second image data to generate the second frame signal.

Figure 3:
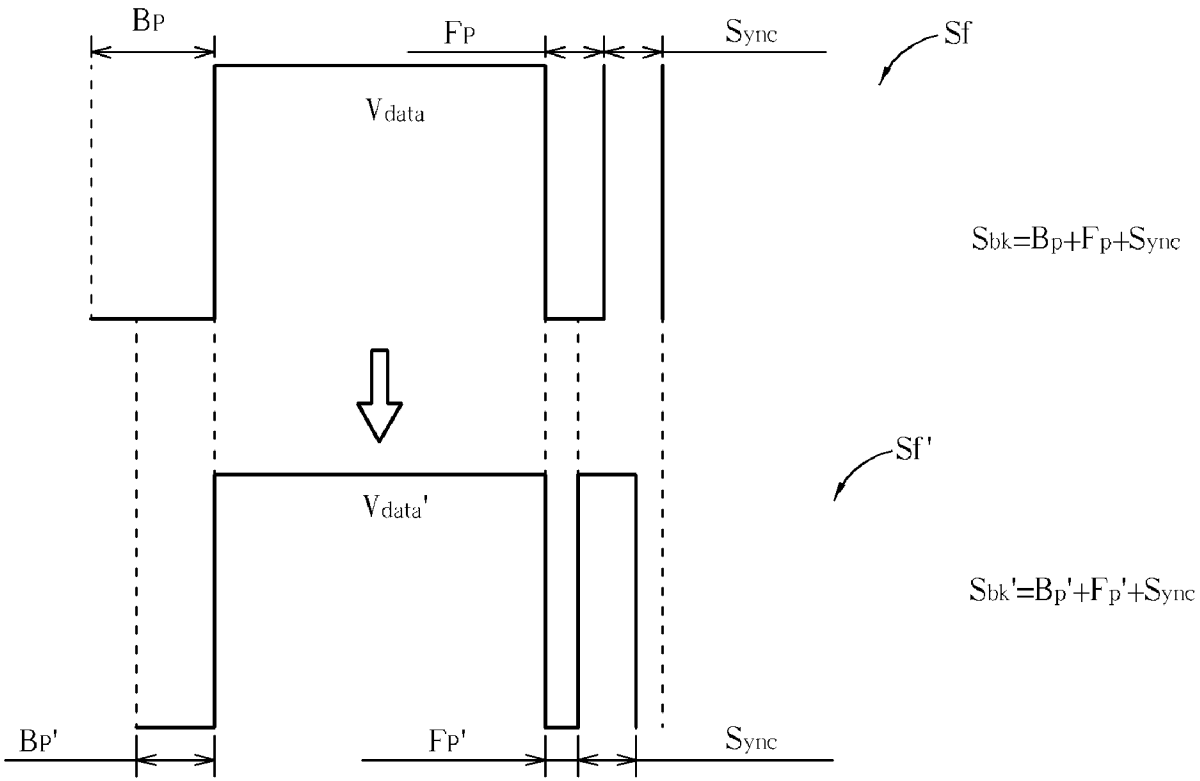
FIG. 3 is a schematic diagram of a frame-signal recombination in FIG. 1 according to an embodiment of the present invention.

Please refer to FIG. 3, which is a schematic diagram of a frame-signal recombination in FIG. 1 according to an embodiment of the present invention. A frame signal Sf is received first. The frame signal Sf conforms to a video timing specification and thus includes a blank signal Sbk and image data Vdata. A back porch signal Bp is coupled to the front of the image data Vdata, and the back of the image data Vdata is followed by a front porch signal Fp and a synchronization signal Sync. Then, the image data Vdata and the blank signal Sbk are separated by digital signal processes. After the signal separation, on one hand the image data Vdata is overdriven and adjusted in frame rate thereof to generate image data Vdata'. On the other hand, the signal lengths of the back porch signal Bp and the front porch signal Fp are both reduced to generate a back porch signal Bp' and a front porch signal Fp'. After the above steps are accomplished, the back porch signal Bp', the image signal Vdata', the front porch signal Fp' and the synchronization signal Sync are combined together based on signal arrangement of the frame signal Sf to generate a frame signal Sf'. As can be known from the above, due to signal separation, the blank signal Sbk does not get involved in the same image processes as the image data Vdata does. This economizes the use of both image processing resources and time. In addition, the frame signal Sf' has a shorter signal length than the frame signal Sf due to length reduction of the front and back porch signals. Thus, the frame signal Sf' requires less transmission bandwidth than the frame signal Sf does and is a better choice for systems with narrow-bandwidth transmission interfaces.

In the prior art, the image process used for the frame signal may occupy massive resources and memory since the blank signal of the frame signal are being processed as well. Besides, the front and back porch signals, which carry no useful information, are not reduced, and therefore direct transmission of the frame signal causes wasteful bandwidth utilization, reducing significant data throughput. Therefore, the present invention separates different components of the frame signal and further performs blank signal reduction to achieve low system resource utilization and low transmission bandwidth requirement.

Figure 4:
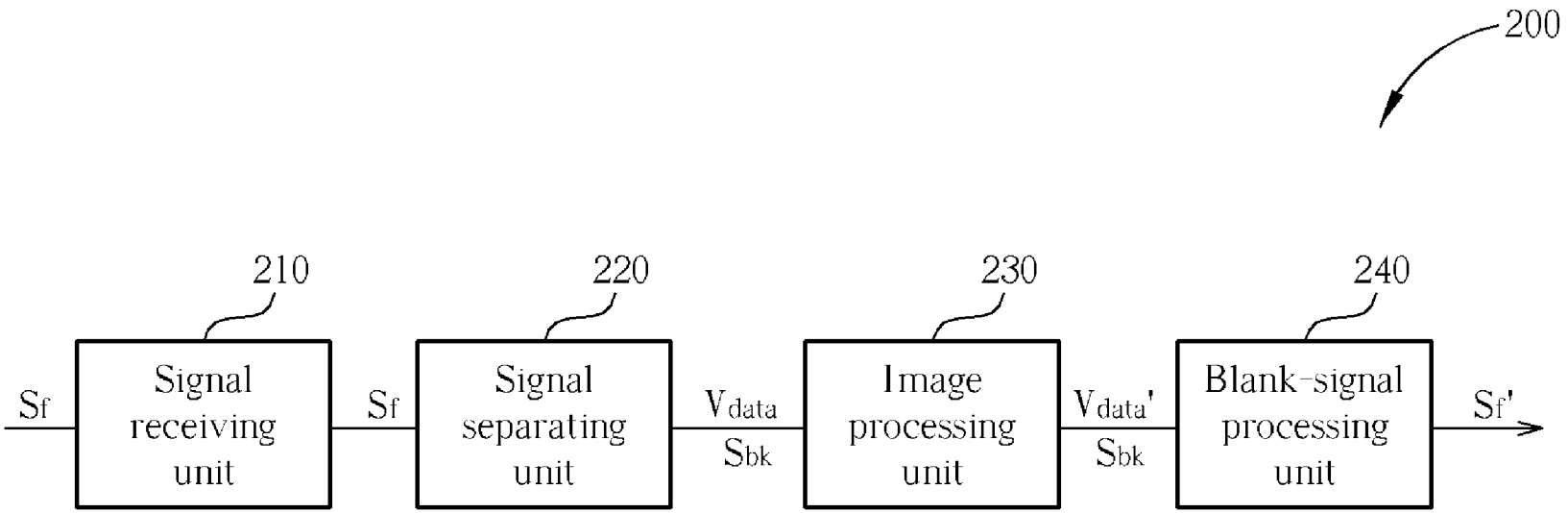
FIG. 4 is a schematic diagram of the device according to an embodiment of the present invention.

Please refer to FIG. 4, which is a schematic diagram of the device 200 according to an embodiment of the present invention. The device 200 is used for realizing signal processing functions according to FIG. 3. The signal receiving unit 210 is used for receiving the frame signal Sf and outputting Sf to the signal separating unit 210. The signal separating unit 220 functions to identify the blank signal Sbk and the image data Vdata from the frame signal Sf, and performs signal separation. The image processing unit 230 performs image processes, such as overdrive, for the image data Vdata so as to generate the image data Vdata'. As the image data Vdata is in process, the blank-signal processing unit 240 simultaneously reduces signal lengths of the front and back porch signals Fp and Bp of the blank signal Sbk to generate the blank signal Sbk' including the front and back porch signals Fp' and Bp'. After receiving the image data Vdata', the blank-signal processing unit 240 combines the blank signal Sbk' with the image data Vdata' according to signal arrangement of the frame signal Sf so as to generate the frame signal Sf'. At last, the frame signal Sf' is transmitted via a transmission interface in the device 200.

Figure 5:
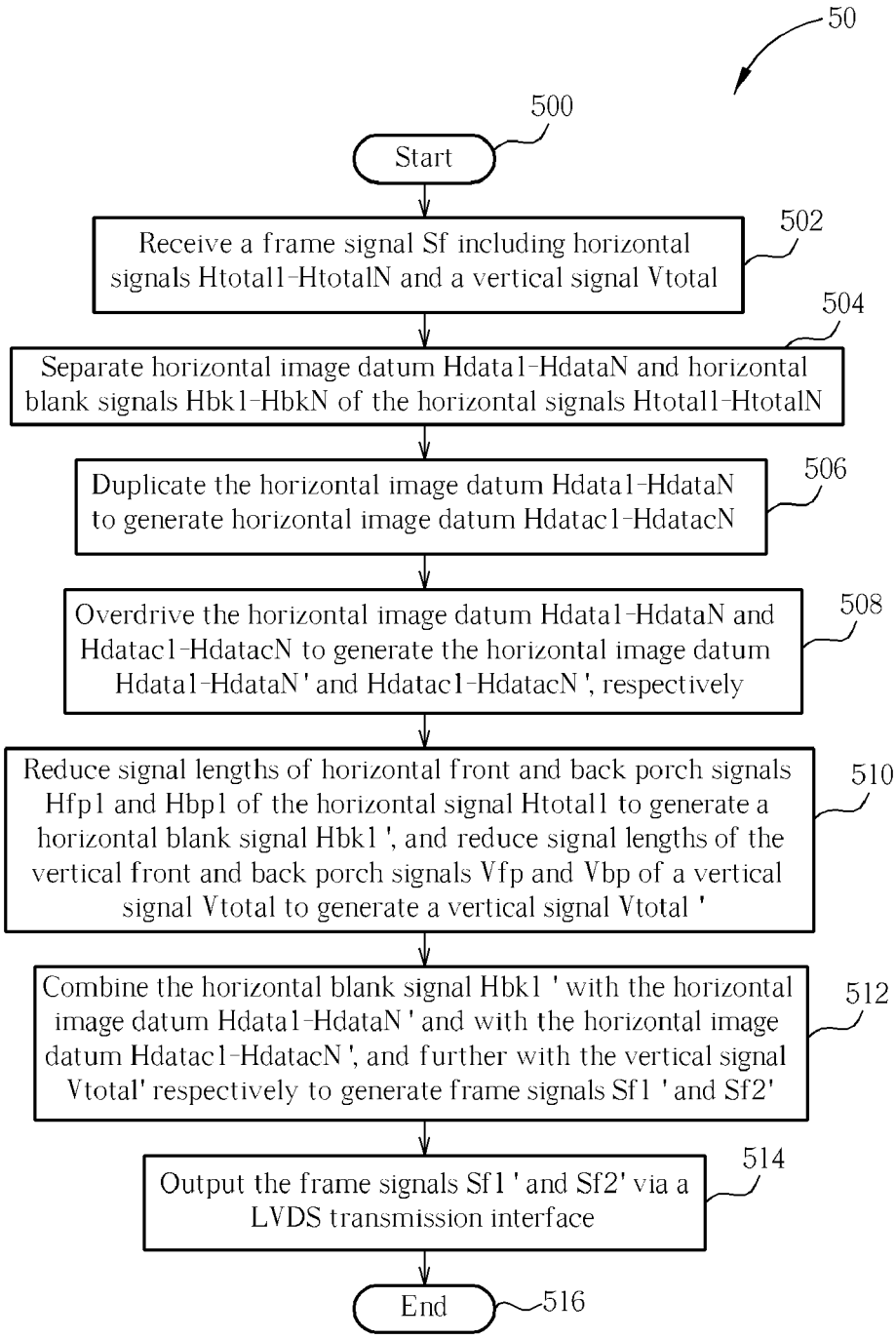
FIG. 5 is a schematic diagram of a process according to an embodiment of the present invention.

Please refer to FIG. 5, which is a schematic diagram of a process 50 according to an embodiment of the present invention. The process 50 is utilized to display images for a display device according to the above-mentioned timing specification and includes the following steps:

Step 500: Start.

Step 502: Receive a frame signal Sf including horizontal signals Htotal1-HtotalN and a vertical signal Vtotal.

Step 504: Separate horizontal image datum Hdata1-HdataN and horizontal blank signals Hbk1-HbkN of the horizontal signals Htotal1-HtotalN.

Step 506: Duplicate the horizontal image datum Hdata1-HdataN to generate horizontal image datum Hdatac1-HdatacN.

Step 508: Overdrive the horizontal image datum Hdata1-HdataN and Hdatac1-HdatacN to generate the horizontal image datum Hdata1'-HdataN' and Hdatac1'-HdatacN', respectively.

Step 510: Reduce signal lengths of horizontal front and back porch signals Hfp1 and Hbp1 of the horizontal signal Htotal1 to generate a horizontal blank signal Hbk1', and reduce signal lengths of the vertical front and back porch signals Vfp and Vbp of a vertical signal Vtotal to generate a vertical signal Vtotal'.

Step 512: Combine the horizontal blank signal Hbk1' with the horizontal image datum Hdata1'-HdataN' and with the horizontal image datum Hdatac1'-HdatacN', and further with the vertical signal Vtotal' respectively to generate frame signals Sf1' and Sf2'.

Step 514: Output the frame signals Sf1' and Sf2' via a low voltage differential signaling (LVDS) transmission interface.

Step 516: End.

Figure 6:
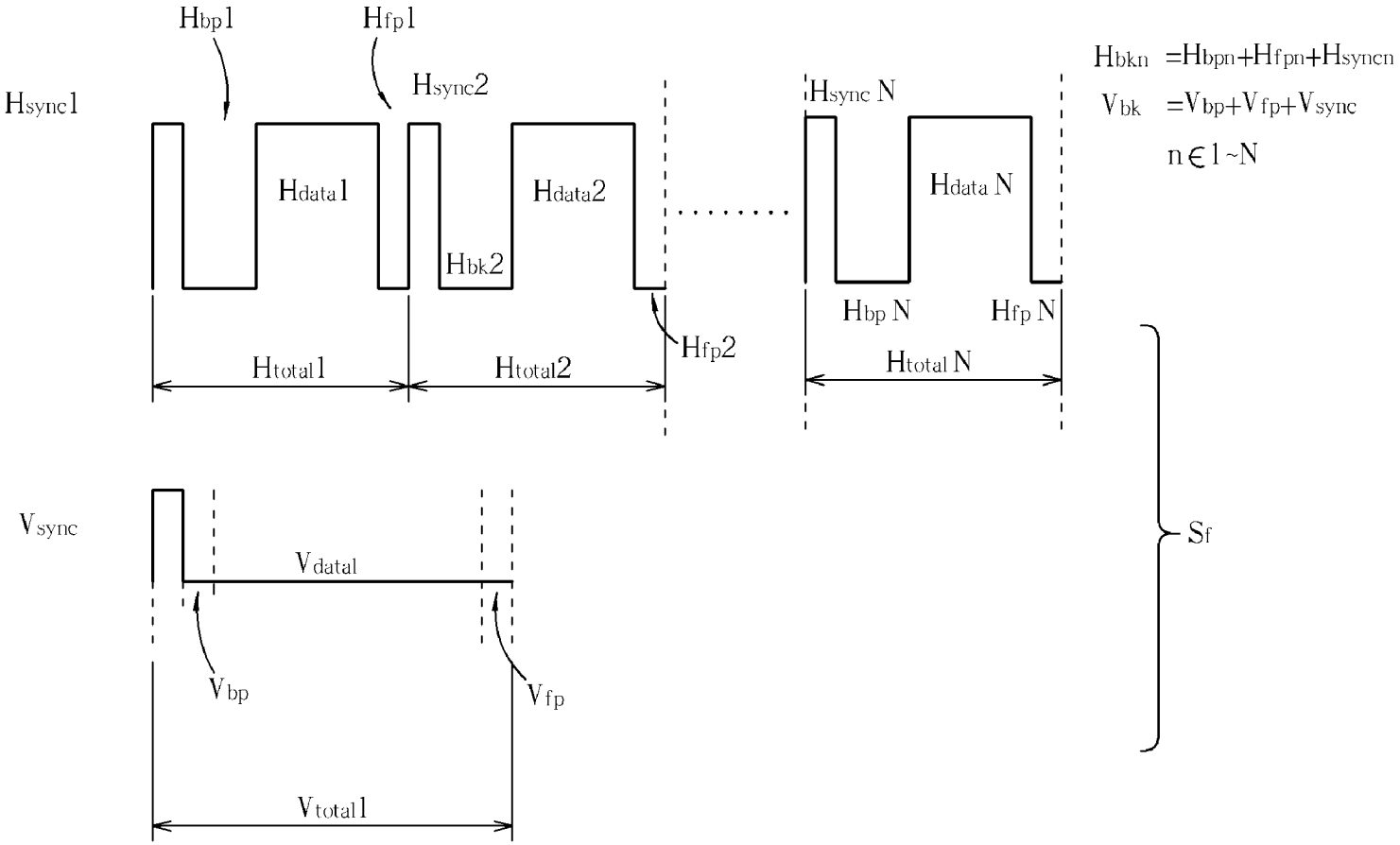
FIG. 6 is a schematic diagram of signal arrangement in the frame signal according to FIG. 5.

Please refer to FIG. 5 and FIG. 6. The signal arrangement in the frame signal Sf is described in FIG. 6. The frame signal Sf includes horizontal signals Htotal1-HtotalN and a vertical signal Vtotal. Each horizontal signal Htotal has the same signal length and signal arrangement, and includes horizontal image data Hdatan and a blank signal Hbkn. Each blank signal Hbkn includes a horizontal front porch signal Hfpn, a horizontal back porch signal Hbpn and a horizontal synchronization signal Hsyncn, where n is 1, . . . , N. The vertical signal Vtotal includes vertical data Vdata and a vertical blank signal Vbk including a vertical front porch signal Vfp, a vertical back porch signal Vbp and a vertical synchronization signal Vsync. Take Red, Blue and Green (RGB) image data with 1280×1024 resolution for example. The horizontal image datum Hdata1-HdataN include 1280 pixel datum each, and each pixel data includes corresponding RGB data. The RGB image data shall include 1024 horizontal lines, and therefore N is 1024. Besides, each horizontal signal Htotal including the horizontal blank signal shall have 1688 pixels according to the above-mentioned timing specification (VESA), and the vertical signal Vtotal shall have 1066 lines. As for Step 504, all of the horizontal image data and the horizontal blank signal Hbk1 are retained after the horizontal image datum Hdata1-HdataN are separated from the horizontal blank signals Hbk1-HbkN. Duplication in Step 506 is used for increasing the frame rate. In Step 508, the horizontal image datum Hdata1-HdataN and Hdatac1-HdatacN are all overdriven so as to generate the horizontal image datum Hdata1'-HdataN' and Hdatac1'-HdatacN'. Overdrive is a process of increasing output voltage for liquid crystals in a very short period according to the horizontal image data, and the detailed operation thereof is well known in the art. In Step 510, only the horizontal blank signal Hbk1 is retained and used for later signal combination since every horizontal blank signal has the same signal length and arrangement. In Step 512, the horizontal blank signal Hbk1' is combined into each of the horizontal image datum Hdata1'-HdataN' and Hdatac1'-HdatacN' in light of the signal arrangement of the horizontal signal Htotal1, and thereby the horizontal signals Htotal1'-HtotalN' and Htotalc1'-HtotalcN' are obtained. Subsequently, the obtained horizontal signals are combined with the vertical signal Vtotal' respectively so as to generate the frame signals Sf1' and Sf2'. As a result, the frame signals Sf1' and Sf2' are similar to the frame signal Sf, and only have difference in signal length and image data context. The signal length of the frame signals Sf1' and Sf2' is shorter than that of the frame signal Sf. In Step 514, the transmission interface is used for outputting frame signals to a display driving device and adopts the LVDS technology having a maximum bandwidth of 85-90 MHz.

Please note that Steps 506 and 508 are exchangeable, which means the horizontal image datum Hdata1-HdataN can be overdriven at first and the overdriven datum are then duplicated. In this embodiment, the frame signal is received one by one, but this invention also works for reception of multiple frame signals at the same time. In addition, the embodiment is preferably used in a digital display device, such as a LCD or a plasma display, so that multiple frame signals for different frames typically appears as a streaming signal. To increase the frame rate, the embodiment duplicates the frame signal Sf before the next frame signal comes, and inserts the duplicated frame signal between the frame signal Sf and the next coming frame signal. Moreover, display time for each frame signal is shortened and thereby the frame rate can be increased.

To summarize the embodiment, the image datum and the blank signals included in the horizontal components of the frame signal are separated from each other. The horizontal image datum is duplicated and the original and duplicated ones are both overdriven. On the other hand, only a horizontal blank signal and a vertical blank signal are reduced in length, and combined with the overdriven image datum to generate two new frame signals outputted via the transmission interface. Regarding the same frame signal applied to the prior art, due to lack of signal separation in Step 504, the horizontal blank signals Hbk1-HbkN would be duplicated as well as the image datum while duplication is performed, resulting in system resource wastes. Furthermore, no blank reducing shown in Step 510 is performed in the prior art. Therefore, the frame signals with increased frame rate may not be able to be transmitted via the transmission interface due to a great data quantity exceeding the transmission bandwidth. Take image data with 1280×1024 resolution for example. As is described from the above, the total data quantity per frame are 1688×1066 pixels in the prior art, whereas the total data quantity per frame could be reduced to 1360×1040 pixels by Step 510 in the embodiment of the present invention. Assume that the frame rate is increased to 120 Hz, and the LVDS transmission interface having the maximum bandwidth of 85-90 MHz is adopted. The data rate can be calculated by the above-mentioned formula as follows.

Data Rate=the horizontal pixel number×the vertical pixel number×the frame rate÷the channel number of the LVDS Therefore, the data rates of the prior art and the embodiment of the present invention are found below.

$$R_{PRIOR_ART}=1688\times1066\times120\div2=107.96\text{ MHz}$$

$$R_{INVENTION}=1360\times1040\times120\div2=84.86\text{ MHz}$$

The data rate of the embodiment of the present invention is obviously adaptive to the provided transmission bandwidth, whereas the data rate of the prior art exceeds the maximum transmission bandwidth, eliminating the possibility of the frame-rate increase. Therefore, the present invention separates blank and data components of the frame signal for less system resource utilization, and further reduces the blank component to diminish required transmission bandwidth, so as to achieve frame-rate increase.

Figure 7:
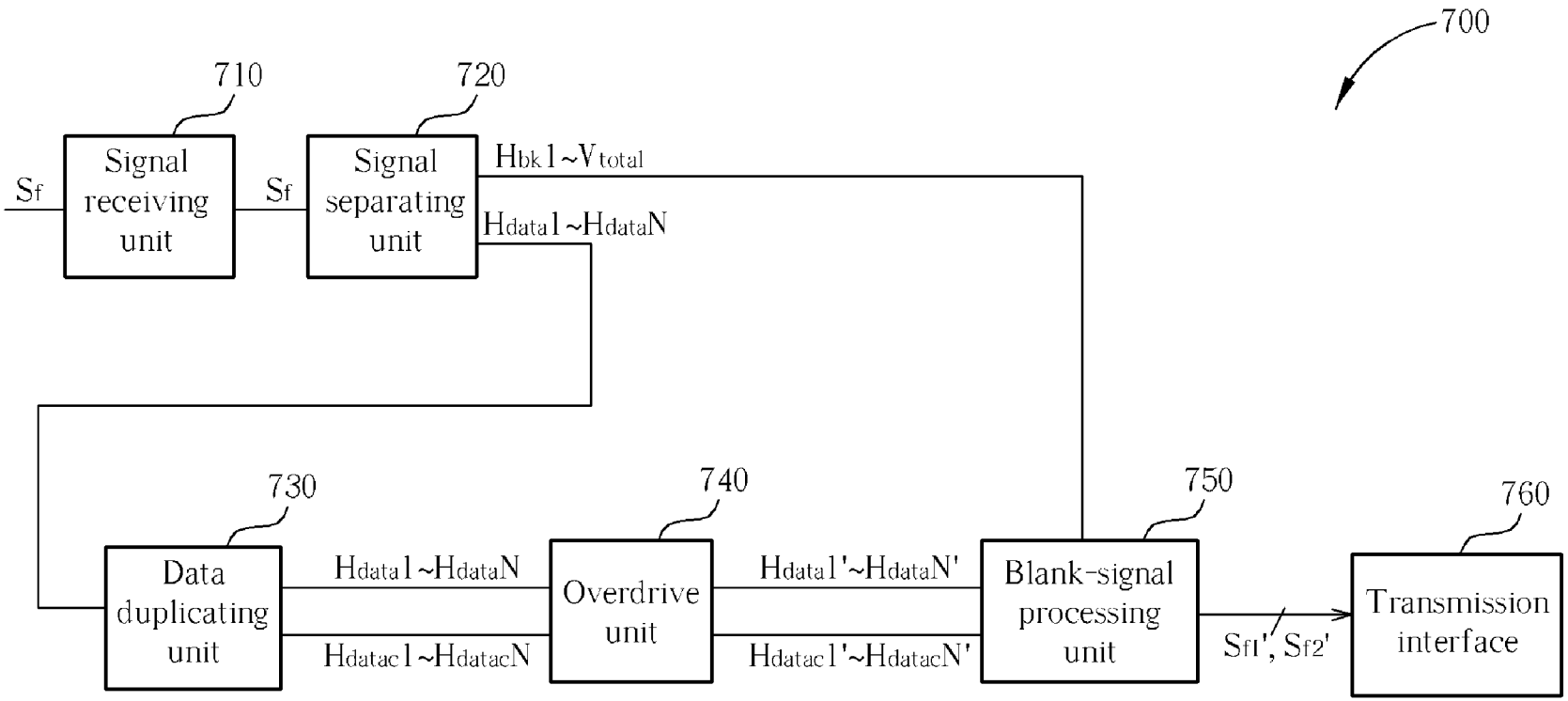
FIG. 7 is a schematic diagram of a device according to an embodiment of the present invention.

Please refer to FIG. 7, which is a schematic diagram of a device 700 according to an embodiment of the present invention. The device 700 is utilized to realize the process 50 and includes a signal receiving unit 710, a signal separating unit 720, a data duplicating unit 730, an overdrive unit 740, a blank-signal processing unit 750 and a transmission interface 760. The device 700 can be applied to LCDs or plasma displays. The signal receiving unit 710 can be implemented by a radio module including an antenna and an analog-to-digital converter for receiving satellite or broadcasting signals. The followings are other alternatives: a 15-pin D-sub or a component video connector for reception of RGB or YcbCr signals. The signal receiving unit 710 receives the frame signal Sf to output to the signal separating unit 720. Besides, the signal receiving unit 710 is capable of transforming signals from analog into digital form in case of the frame signal Sf being received in analog form. The signal separating unit 720 is used for separating the horizontal image datum Hdata1-HdataN and the horizontal blank signals Hbk1-HbkN of the horizontal signals Htotal1-HtotalN. After signal separation, the signal separating unit 720 outputs the horizontal image datum Hdata1-HdataN to the data duplicating unit 730, and outputs the horizontal blank signals Hbk1 and the vertical signal Vtotal to the blank-signal processing unit 750. The data duplicating unit 730 is used for duplicating the horizontal image datum Hdata1-HdataN to generate the horizontal image datum Hdatac1-HdatacN. The overdrive unit 740 is used for overdriving each of the horizontal image data Hdata1-HdataN and Hdatac1-HdatacN so as to generate the horizontal image datum Hdata1'-HdataN' and Hdatac1'-HdatacN', respectively. The blank-signal processing unit 750 is used for reducing signal lengths of the horizontal blank signal Hbk1 and the vertical signal Vtotal. By reducing signal lengths of the horizontal front porch signal Hfp1, the horizontal back porch signal Hbp1, the vertical front porch signal Vfp and the vertical back porch signal Vbp, the blank-signal processing unit 750 generates the horizontal blank signal Hbk1' and the vertical signal Vtotal'. After that, the blank-signal processing unit 750 performs combination of the horizontal and vertical signals. In light of the horizontal signal arrangement of the frame signal Sf, such as the horizontal signal Htotal1, the horizontal blank signal Hbk1' is combined with each of the horizontal image datum Hdata1'-HdataN' and Hdatac1'-HdatacN'. Furthermore, each combination result of the horizontal component is combined with the vertical signal Vtotal' so as to generate the frame signals Sf1' and Sf2'. As last, the blank-signal processing unit 750 outputs the frame signals Sf1' and Sf2' to the transmission interface 760.

Please note that the frame signals could be multi-dimensional digital signals, and are not limited to one or two dimensions. The image processes adopted in the present invention are just not limited to overdrive and frame rate adjustment. Those skilled in the art can embed information into the front or back porch signal if necessary, where the embedded information quantity should not affect the blank reducing.

In conclusion, the present invention only performs image processes on the image data instead of the whole frame signal, and besides reduces the signal length of the blank signal so as to generate a frame signal with shorter signal length than the original. Therefore, the present invention can save system resources and memory space for the image processes and is adaptive to the presenting transmission interface.

Those skilled in the art will readily observe that numerous modifications and alterations of the device and method may be made while retaining the teachings of the invention.

What is claimed is:

1. A method of enhancing image display efficiency comprising:

receiving a first frame signal, the first frame signal comprising a first blank signal and first image data, the first blank signal comprising a first synchronization signal, a first front porch signal and a first back porch signal;

separating the first blank signal and the first image data;

processing the first image data to generate second image data; and combining a second blank signal with the second image data to generate a second frame signal, the second blank signal comprising a second synchronization signal, a second front porch signal and a second back porch signal.

2. The method of claim 1, wherein processing the first image data to generate the second image data comprises:

adjusting a frame rate of the first image data to generate third image data; and performing overdrive for the third image data to generate the second image data.

3. The method of claim 1, wherein processing the first image data to generate the second image data comprises:

performing overdrive for the first image data to generate third image data; and adjusting a frame rate of the third image data to generate the second image data.

4. The method of claim 1, wherein the second front porch signal has a shorter signal length than the first front porch signal does.

5. The method of claim 1, wherein the second back porch signal has a shorter signal length than the first back porch signal does.

6. A device for enhancing image display efficiency comprising:

a signal receiving unit for receiving a first frame signal, the first frame signal comprising a first blank signal and first image data, the first blank signal comprising a first synchronization signal, a first front porch signal and a first back porch signal;

a signal separating unit for separating the first blank signal and the first image data;

a image processing unit for processing the first image data to generate second image data; and a blank-signal processing unit for combining a second blank signal with the second image data to generate a second frame signal, the second blank signal comprising a second synchronization signal, a second front porch signal and a second back porch signal.

7. The device of claim 6, wherein the image processing unit comprises:

a frame-rate adjusting unit for adjusting a frame rate of the first image data to generate third image data; and an overdrive unit for performing overdrive for the third image data to generate the second image data.

8. The device of claim 6, wherein the image processing unit comprises:

an overdrive unit for performing overdrive for the first image data to generate third image data; and a frame-rate adjusting unit for adjusting a frame rate of the third image data to generate the second image data.

9. The device of claim 6, wherein the second front porch signal has a shorter signal length than the first front porch signal does.

10. The device of claim 6, wherein the second back porch signal has a shorter signal length than the first back porch signal does.

* * * * *